US005820128A

United States Patent [19]

Brunelle

[11] Patent Number: 5,820,128

[45] Date of Patent: Oct. 13, 1998

[54] METHOD OF PLAYING A CARD GAME

[76] Inventor: Kenneth J. Brunelle, P.O. Box 671209, Dallas, Tex. 75367

[21] Appl. No.: 942,846

[22] Filed: Oct. 2, 1997

[51] Int. Cl.[6] ..... A63F 1/00

[52] U.S. Cl. ..... 273/292

[58] Field of Search ..... 273/292, 303, 273/304, 305, 306

[56] References Cited

U.S. PATENT DOCUMENTS

| | | | |
|---|---|---|---|
| 5,288,081 | 2/1994 | Breeding | 273/292 |
| 5,380,012 | 1/1995 | Jones et al. | 273/292 |
| 5,407,208 | 4/1995 | Keller et al. | 273/292 |
| 5,415,414 | 5/1995 | Savage | 273/306 |
| 5,417,430 | 5/1995 | Breeding | 273/292 |
| 5,437,462 | 8/1995 | Breeding | 273/292 |
| 5,544,892 | 8/1996 | Breeding | 273/292 |
| 5,597,162 | 1/1997 | Franklin | 273/292 |
| 5,605,333 | 2/1997 | Field | 273/274 |
| 5,692,755 | 12/1997 | Gutierrez | 273/292 |
| 5,697,614 | 12/1997 | Potter et al. | 273/292 |
| 5,718,431 | 2/1998 | Ornstein | 273/292 |
| 5,720,484 | 2/1998 | Hsu | 273/292 |
| 5,725,215 | 3/1998 | Hesse | 273/292 |

*Primary Examiner*—William E. Stoll
*Attorney, Agent, or Firm*—Dennis T. Griggs

[57] ABSTRACT

A wagering card game is played with a standard fifty-two card poker deck and a count limit card that is permanently assigned as the third card of the dealer's hand. Each player makes a bet, divides the bet in half and places each half in two separate betting areas on a playing surface. Two cards are dealt face down to each player and to the dealer. The players inspect their cards and keep or trade one or both. If a player trades, he surrenders one-half his total wager. Replacement cards are dealt face down and the dealer collects the surrendered bets. After evaluating his hand, each player then places his cards face up in progressive order into card docks provided on the playing surface. A third card is then dealt face down to each player, but not to the dealer. The dealer's third card is a count limit card or the representation of a count limit card having a predetermined count value (for example 5) that is imprinted on the count limit card or on the playing surface, and is displayed at all times. The dealer turns over his cards, combines his dealt cards with his count limit card and states his total. He then turns over each player's third card one at a time, compares each player's hand with the dealer's hand, determines whether the player is a winner or not and pays or collects on each hand.

15 Claims, 3 Drawing Sheets

METHOD OF PLAYING A CARD GAME

BACKGROUND OF THE INVENTION

Casino gambling involves many different games of chance. Many games involve playing cards that are used in some form of competition with the casino or against other players. In the most popular casino games, players compete against the casino, the games are fast-paced, provide more than one opportunity to win and the bets are resolved quickly. Generally, the shorter the time between placing a bet and the winning of a hand, the more popular the game.

Some casino card games are variations on poker, blackjack or baccarat in which winning hands are determined according to generally accepted rules of card value and rank. In baccarat and blackjack, the face cards are assigned numerical values. In blackjack, the object is to beat the dealer by scoring more than the dealer, but no more than twenty one. Additionally, blackjack may produce more than one winning hand during a round of play. Baccarat is a scoring game wherein the players play against each other in an effort to score as close to nine as possible. In poker, various combinations of cards determine the winner of each round and there is only one winning hand in each round of play.

Popular casino games based on the strategy and card priority of poker provide multiple opportunities to win. Caribbean Stud, a five-card poker game currently played in casinos, provides more than one chance to win with a particular hand. A limitation on the play of Caribbean Stud is the requirement for the dealer to have a qualifying hand, e.g., Ace-King. A player's hand may be a winner, but the player may lose the opportunity to receive a large payout because the dealer did not receive a qualifying hand.

Another popular casino game comparable to Caribbean Stud is Let It Ride, a game based on poker strategy and card priority. In the play of Let It Ride, as described in U.S. Pat. No. 5,437,462, three cards are dealt to the player and two to the dealer. The player then combines his cards with the dealer's cards to produce a poker hand. Let It Ride is popular because of its fast-paced play, simple strategies, the opportunity to participate in an additional jackpot and multiple opportunities to win in the same hand.

A limitation on the play of Let It Ride is the apparent complexity of the betting. Three bets are placed on each hand with two of the bets being resolved, or withdrawn by the player, during three stages of play. A fourth bet is a bonus jackpot bet and is forfeited if the player does not receive a bonus hand. A prospective player must overcome his reluctance to wager three times on one hand to begin play. The option to withdraw a portion of the wager is not productive for the casino—the player is allowed to take back a portion of the bet that has already been committed.

The highest ranked poker hand is a winner for both Caribbean Stud and Let It Ride. Based on the method of betting, both games allow multiple opportunities to win, and generally meet the requirements for a popular casino game. However, the dealer-qualifying requirement of Caribbean Stud and the complexities of the betting requirements of Let It Ride are discouraging to the average player.

Other wagering card game methods are known. For example in Padukee, as described in U.S. Pat. No. 5,415,414, the player places two bets plus a bonus jackpot wager.

BRIEF SUMMARY OF THE INVENTION

The wagering card game of the present invention is played with a deck of fifty-two playing cards, preferably a poker deck, and a count value limit card or a representation of a count limit card having a predetermined count value N, where N is a whole number, for example 5. Each playing card is assigned a count value with the numbered cards having the corresponding whole number values 2 through 10, respectively; the face cards (King, Queen, Jack) each having an assigned count value of ten; and each Ace having an assigned count value of one. Each player wagers a minimum amount by posting one-half of his total bet in each cache of a two-cache wager box provided on a playing surface. Each player may then pay an ante stake for the right to participate in a bonus payout. The dealer collects all ante stakes and deals two cards, face down, to all the players and the dealer. The players pick up their cards and evaluate them for further play. Each player then has the following options: (1) he can hold both cards and his total wager intact for further play; or, (2) he can exchange one or both cards at a trade cost of one half of his total wager for further play.

The dealer then deals replacement cards, face down and collects one-half of the total bet from each trade option player. The players inspect their hands and place their cards into prearranged card docks in ascending, progressive order: the card with the lowest count value is placed in card dock one and the remaining card is placed in card dock two. The dealer then deals a third card face down in card dock three to all players, but not to the dealer. The dealer has a numerical count value N assigned to his hand by a count limit card (not taken from the game deck) or by the representation of a count limit card that is positioned or imprinted on the playing surface in the dealer's third card dock as the third card of his hand.

The dealer then turns over and reveals his first two cards (in the same order as dealt), combines the count of his revealed cards with the count of his assigned count limit card and announces his total score or suited sequence value, if any. The dealer then reveals the third card of each player, one player at a time, totals the count of each hand, determines winners, and collects or pays all bets according to a predetermined regular payout schedule. If one or more winning hands qualify for a bonus payout, the dealer also pays the qualifying winner(s) a bonus amount that corresponds with a bonus payout schedule.

DETAILED DESCRIPTION OF THE INVENTION

Figure 1:
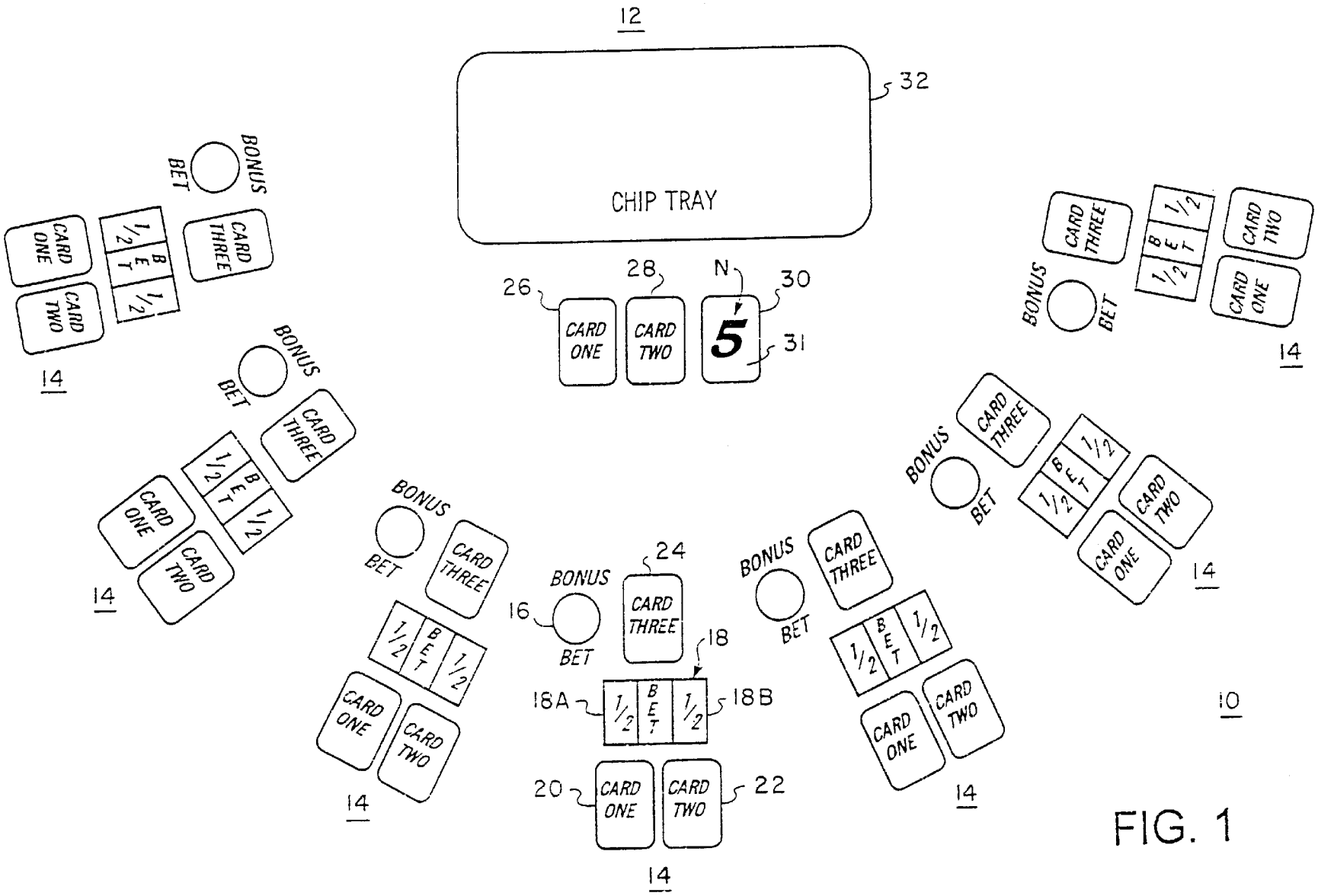
FIG. 1 illustrates the table layout of a playing surface used in the wagering game of the present invention.

Referring to FIG. 1, the wagering game of the present invention referred to herein as "Louisiana Low", is a "low" card game played on a real or simulated playing surface 10. The playing surface is preferably preprinted felt covering that is placed on top of a gambling table. Alternatively, the playing surface can be simulated on a video screen and the game can be played via computer under software control with the cards being simulated and the player participating at interactive video station. Depicted on the playing surface 10 is a single dealer position 12 and multiple player positions 14. The layout of each player position 14 is identical to all other player positions. Although seven player positions 14 are shown, as many as ten players or as few as one player and one dealer may play the game.

Each player position 14 includes a bonus ante circle 16 for receiving an ante stake that is required to make the player eligible to participate in a bonus payout; a two-cache wager box 18 for receiving the player's wager; a card dock 20 labeled card one for receiving a first card; a card dock 22 labeled card two for receiving a second card; and, a card dock 24 labeled card three for receiving a third card.

Figure 3:
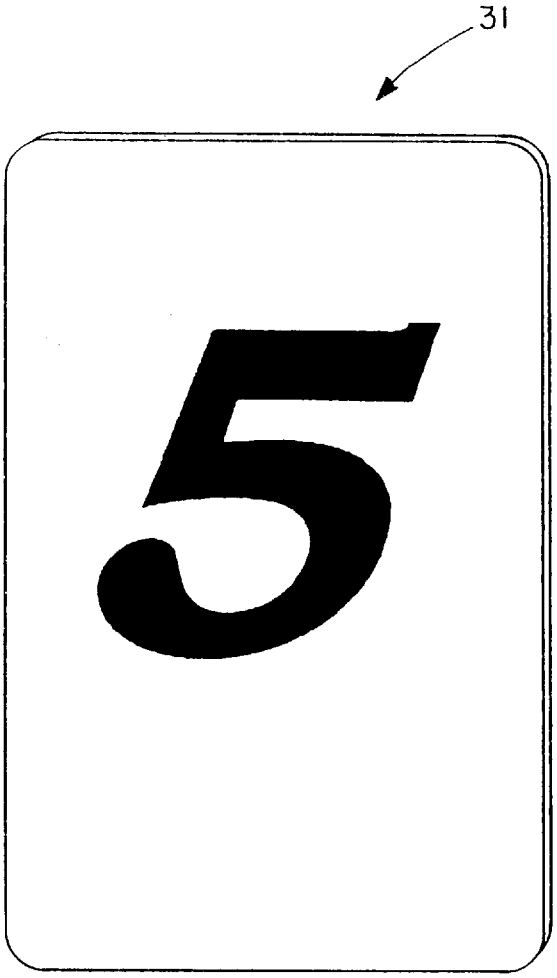
FIG. 3 is a perspective view of count limit card imprinted with a non-suited whole number that is permanently assigned as the third card of the dealer's hand.

The dealer position 12 includes two card docks 26 and 28, labeled card one and card two, and a third card dock 30. Preferably, a predetermined numerical count value N, for example the non-suited whole number 5, is imprinted on the playing surface 10 inside the dealer's third card dock 30 and thus serves as the permanent third card of the dealer's hand. According to an alternative embodiment as shown in FIG. 3, a non-suited count limit card 31 (not taken from the game deck) having a count value N, for example the number 5, is placed inside the third card dock 30 and is permanently assigned as the third card of the dealer's hand. A rectangular area 32 is designated for the dealer's chip tray.

Figure 2:
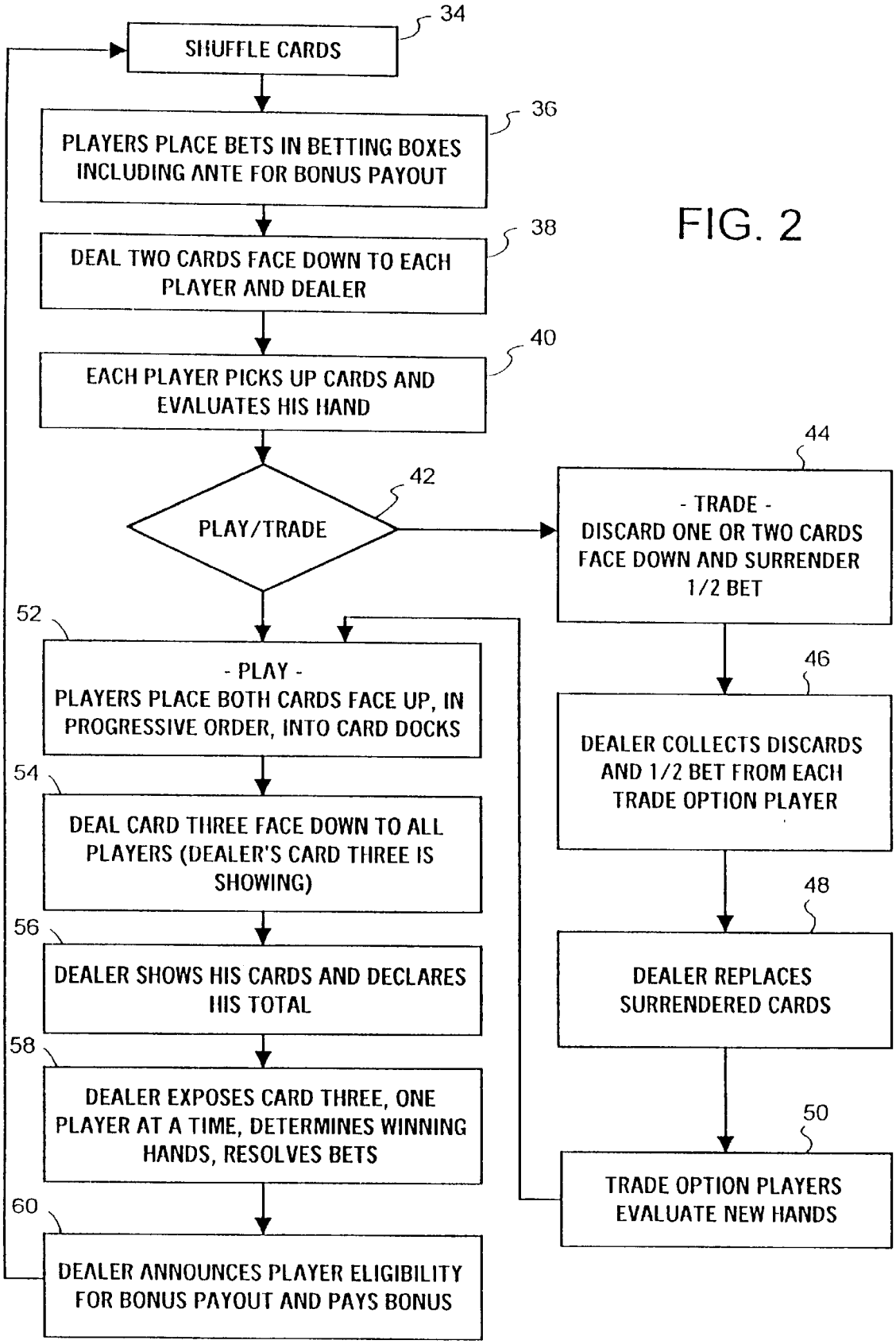
FIG. 2 is a block diagram representing the flow of play in the game.

Referring to the flow diagram in FIG. 2, a standard poker deck of fifty-two cards is shuffled at block 34. The deck may be shuffled manually by the dealer, by an automatic shuffling machine or by computer. The players then place bets, block 36, wherein each player's total wager is divided in half and each half is posted into a separate cache 18A, 18B of the wager box 18, respectively. An ante stake that permits a player having a winning hand to participate in a bonus payout is made by posting a predetermined ante amount in the bonus ante circle 16.

After the players have posted their bets, the dealer deals two cards face down to each player and to the dealer, block 38. The players pick up their cards and evaluate their hands, block 40. The dealer's first two cards remain face down. At this point, each player decides whether to hold or trade, block 42. If a player decides to trade, he discards one or both of his cards (face down) and surrenders one half of his bet, block 44. The dealer collects the surrendered bets from each trade option player, block 46. The dealer then deals replacement cards face down and the trade option players evaluate their new hands, block 48.

Each player then places his cards face up in progressive order into the first card dock 20 and second card dock 22, block 52. Progressive order placement is required to qualify the hand for a particular winning suited sequence, for example A23 of the same suit. The dealer then deals a third card face down to each player into the third card dock 24, block 54. The dealer does not deal a third card to himself, since his third card and its count value N are permanently displayed in card dock 30 for all to see. The dealer then turns his first two cards face up in the same order as dealt and declares the total count and/or suited sequence value of his hand, block 56, by combining the count values of his dealt cards with the count value N of his assigned third card, count limit card 31, or representation thereof in card dock 30, as shown in FIG. 1.

In the preferred embodiment, the numerical count value N of the dealer's count limit card is a whole number selected from the set of numbers {4, 5, 6}. The count value N of the dealer's permanently assigned third card establishes the low count limit (2+N) and the high count limit (20+N) on the total count value of the dealer's hands. The selected value also determines the odds of winning and losing.

The dealer then turns over each player's third card, one at a time, determines winning hands and resolves table and bonus bets, block 58, according to a regular payout schedule, for example as shown in Table IV and according to a bonus payout schedule, for example as shown in Table V.

It will be apparent that the card game of the present invention overcomes the limitations of conventional casino games such as Caribbean Stud and Let It Ride. "Louisiana Low" includes all the attributes of a popular wagering card game: it is simple to play and fast-paced; a player is able to win a regular payout and a bonus payout with the same hand; and the game provides for the possibility of multiple winners during the play of each hand.

For example, as shown in Table I, Table II and Table III, multiple winners include a hand with the lowest score, a hand with a score lower than the dealer, a hand with a particular score of 30, and a hand with a particular suited sequence of cards, e.g., Ace, two and three of hearts. All winning hands are paid during the same round of play according to a regular payout schedule, for example as shown in Table IV. The hands of those winners who have paid an ante for bonus payout are also resolved and paid at the same time according to a bonus payout schedule, for example as shown in Table V.

The foregoing is a description of a preferred embodiment which illustrates the best mode for playing the game of the present invention. The table values given herein are for explanation purposes only.

TABLE I

EXAMPLE HANDS SHOWING PAYOUT SCORES WITH BONUS WINNERS

| Position | Displayed Hand | | Payout to the Player (Reference Tables IV & V) |
|---|---|---|---|
| Dealer | Card one: | Ace of diamonds | Score is 16 |
| | Card two: | 10 of clubs | Dealer receives no payout. |
| | Card three: | 5 (assigned) | |
| Player 1 | Card one: | 10 of hearts | Score is 30 for low. |
| | Card two: | 10 of spades | Pays 2 times the amount in |
| | Card three: | King of clubs | player's Wager Box. |
| Player 2 | Card one: | 6 of spades | Score is 22. |
| | Card two: | 7 of hearts | Pays nothing. |
| | Card three: | 9 of spades | Player loses bet. |
| Player 3 | Card one: | Ace of hearts | Score is Ace, 2, 3 (suited |
| | Card two: | 2 of hearts | in progressive order). |
| | Card three: | 3 of hearts | Pays 100 times the amount in player's Wager Box. Participates in Bonus Payout - Receives $2000. |
| Player 4 | Card one: | Queen of hearts | Score is 17. |
| | Card two: | 2 of spades | Pays nothing. |
| | Card three: | 5 of hearts | Player loses bet. |
| Player 5 | Card one: | 3 of diamonds | Score is 15, beats dealer. |
| | Card two: | 4 of diamonds | Pays 1 times the amount in |
| | Card three: | 8 of hearts | player's Wager box (even money). |
| Player 6 | Card one: | Ace of spades | Score is 16, tying dealer. |
| | Card two: | 5 of clubs | Pays nothing (push). |
| | Card three: | King of hearts | Player retains bet. |

TABLE II

EXAMPLE HANDS WITH NO BONUS WINNER

| Position | Displayed Hand | | Payout to the Player (Reference Tables IV) |
|---|---|---|---|
| Dealer | Card one: | 3 of spades | Score is 9 |
| | Card two: | Ace of diamonds | Dealer receives no payout. |
| | Card three: | 5 (assigned) | |
| Player 1 | Card one: | King of hearts | Score is 24. |

TABLE II-continued

| EXAMPLE HANDS WITH NO BONUS WINNER | | | |
|---|---|---|---|
| Position | Displayed Hand | | Payout to the Player (Reference Tables IV) |
| | Card two: | 8 of diamonds | Pays nothing. |
| | Card three: | 6 of hearts | Player loses bet. |
| Player 2 | Card one: | Ace of clubs | Score is 9. |
| | Card two: | 6 of hearts | Pays nothing (push). |
| | Card three: | 2 of clubs | Player retains bet. |
| Player 3 | Card one: | 10 of diamonds | Score is 29. |
| | Card two: | Jack of clubs | Pays nothing. |
| | Card three: | 9 of hearts | Player loses bet. |
| Player 4 | Card one: | 3 of hearts | Score is 9. |
| | Card two: | 3 of diamonds | Pays nothing (push). |
| | Card three: | 3 of clubs | Player retains bet. |
| Player 5 | Card one: | 2 of diamonds | Score is 8, beats dealer. |
| | Card two: | 2 of hearts | Pays 3 times the amount |
| | Card three: | 4 of clubs | in player's Wager Box and pays $6.00 in Bonus Payout. |
| Player 6 | Card one: | Ace of spades | Score is 16. |
| | Card two: | 5 of clubs | Pays nothing. |
| | Card three: | King of hearts | Player loses bet. |

TABLE III

| EXAMPLE HANDS WITH TRADE OPTION PLAYERS | | | | | |
|---|---|---|---|---|---|
| Position | First two cards | | Final hand | | Payout to Player (Ref. Tables IV and V) |
| Dealer | Card one: | 7 of clubs | Card one: | 7 of clubs | Score: 20 |
| | Card two: | 8 of hearts | Card two: | 8 of hearts | Dealer receives no payout |
| | | | Card three: | 5 (assigned) | |
| | Can't discard | | | | |
| 1 | Card one: | 5 of spades | Card one: | 5 of spades | Score: 16 |
| | Card two: | Ace of clubs | Card two: | A of clubs | Pays 1 times amount in the player's wager box |
| | | | Card three: | Queen of clubs | |
| | Hold cards | | | | |
| 2 | Card one: | Ace of spades | Card one: | Ace of spades | Score: 10 |
| | Card two: | 2 of spades | Card two: | 2 of spades | Beats dealer |
| | | | Card three: | 7 of hearts | Pays 1 times amount in player's wager box |
| | Hold cards | | | | |
| 3 | Card one: | 10 of hearts | Card one: | 4 of clubs | Score: 7 |
| | Card two: | 10 of diamonds | Card two: | 2 of hearts | Pays 4 times total left in wager box, also pays $10.00 bonus payout. |
| | | | Card three: | Ace of diamonds | |
| | Discard both, surrender ½ amount in wager box | | | | |
| 4 | Card one: | King of diamonds | Card one: | King of spades | Score: 29 |
| | Card two: | 6 of hearts | Card two: | Queen of spades | Dealer wins. |
| | | | Card three: | 9 of spades | Pays nothing |
| | Discard both, surrender ½ amount in wager box | | | | Player loses bets. |
| 5 | Card one: | Queen of hearts | Card one: | 9 of clubs | Score: 21 |
| | Card two: | 3 of spades | Card two: | 3 of spades | Dealer wins. |
| | | | Card three: | 9 of diamonds | Pays nothing |
| | Discard one, surrender ½ amount in wager box | | | | Player loses bets. |

TABLE IV

| REGULAR PAYOUT SCHEDULE | | |
|---|---|---|
| Point Count Lower than Dealer | pays | 1 to 1 |
| Thirty for Low | pays | 2 to 1 |
| Eight for Low | pays | 3 to 1 |
| Seven for Low | pays | 4 to 1 |
| Six for Low | pays | 5 to 1 |
| Five for Low | pays | 8 to 1 |
| Four for Low | pays | 11 to 1 |

TABLE IV-continued

| REGULAR PAYOUT SCHEDULE | | |
|---|---|---|
| Three for Low | pays | 50 to 1 |
| A23 (same suit, in progressive order) | pays | 100 to 1 |

TABLE V

| BONUS PAYOUT SCHEDULE | | |
|---|---|---|
| A23 (same suit, in progressive order) | pays | $2000.00 |
| Three for Low | pays | $200.00 |
| Four for Low | pays | $75.00 |
| Five for Low | pays | $50.00 |
| Six for Low | pays | $20.00 |
| Seven for Low | pays | $10.00 |
| Eight for Low | pays | $6.00 |

I claim:

1. A method of playing a wagering card game between a dealer and one or more players comprising the following steps:

each player placing a wager to participate in the card game;

dealing a hand of two or more cards from a deck of cards to each player and to the dealer, respectively;

assigning a count limit card or a representation of a count limit card having a predetermined numerical count value to the dealer's hand; and, resolving each player's bet based on the total count value of each player's hand relative to the total count value of the dealer's hand.

2. A method of playing a wagering card game as set forth in claim 1, including the steps:

each player evaluating his cards to determine whether to trade or to hold them;

collecting a portion of a player's wager based on that player's decision to trade one or more cards; and, dealing one or more replacement cards to each trading player.

3. A method of playing a wagering card game as set forth in claim 1, including the steps:

one or more players paying an ante to become eligible to participate in a bonus payout; and, declaring an eligible player's hand to be a winning hand for bonus payout if the total count value of that player's hand is a single digit number.

4. A method of playing a wagering card game as set forth in claim 1, including the steps:

each player dividing his wager in half and placing the half wagers into separate wager boxes, respectively;

each player evaluating his cards to determine whether to trade or to hold them;

collecting half of a player's wager from one of the wager boxes in response to that player's decision to trade one or more cards; and, dealing one or more replacement cards to each trading player.

5. A method of playing a wagering card game as set forth in claim 1, including the step:

declaring a player's hand to be a winning hand if the total count value of that player's hand is lower than the total count value of the dealer's hand.

6. A method of playing a wagering card game as set forth in claim 1, including the step:

selecting the numerical count value of the dealer's limit card from the set of numbers {4, 5, 6}.

7. A method of playing a wagering card game as set forth in claim 1, wherein the predetermined numerical count value of the dealer's count limit card is the number 5.

8. A method of playing a wagering card game as set forth in claim 1, including the step:

declaring a player's hand to be a winning hand eligible for bonus payout if the cards dealt to that player establish a suited sequence.

9. A method of playing a wagering card game as set forth in claim 1, including the steps:

each player arranging and displaying two or more cards of his hand face-up in progressive order prior to receiving the deal of a further playing card to his hand; and, declaring a player's hand to be a winning hand if a further playing card dealt to that player establishes a suited sequence in combination with said two or more arranged cards.

10. A method of playing a wagering card game between a dealer and one or more players comprising the following steps:

each player posting a wager to participate in the card game;

dealing one or more cards from a deck of cards to each player and a like number of cards to the dealer, respectively;

assigning a count limit card or a representation of a count limit card having a predetermined count value to the dealer's hand;

dealing one additional playing card from the deck to each player; and, resolving each player's wager based on the total count value of each player's hand relative to the total count value of the dealer's hand.

11. A method of playing a wagering card game as set forth in claim 10, including the steps:

one or more players paying an ante to become eligible to participate in a bonus payout; and, declaring an eligible player's hand to be a winning hand for bonus payout if the one additional playing card dealt to that player establishes a suited sequence in combination with the one or more cards previously dealt to that player.

12. A method of playing a wagering card game as set forth in claim 10, including the steps:

each player arranging and displaying his cards face up in progressive order prior to receiving said one additional playing card.

13. A method of playing a wagering card game as set forth in claim 10, including the step:

declaring a player's hand to be a winning hand if the one additional playing card dealt to that player establishes a suited sequence in combination with the one or more cards previously dealt to that player.

14. A method of playing a wagering card game as set forth in claim 10, including the steps:

each player evaluating his cards to determine whether to trade or to hold them;

collecting a portion of a player's wager in response to that player's decision to trade one or more cards; and, dealing one or more replacement cards to each trading player.

15. A method of playing a wagering card game between a dealer and one or more players comprising the following steps:

each player placing a wager to participate in the card game;

dealing two or more cards from a deck of cards to each player and a like number of cards to the dealer, respectively;

assigning a count limit card or a representation of a count limit card to the dealer's hand, the count limit card having a predetermined numerical count value;

each player evaluating his cards to determine whether to trade or to hold them;

collecting a portion of a player's wager in response to that player's decision to trade one or more cards;

dealing one or more replacement cards to each trading player;

dealing one additional playing card from the deck to each player;

revealing the dealer's hand and determining its total count value;

revealing each player's hand and determining its total count value; and resolving each player's wager based on the total count of the playing cards in each player's hand relative to the total count of the playing cards and the count limit card in the dealer's hand.

* * * * *